US010157696B2

(12) United States Patent
Nonen et al.

(10) Patent No.: US 10,157,696 B2
(45) Date of Patent: Dec. 18, 2018

(54) COMMUNICATION CABLE

(71) Applicant: Hitachi Metals, Ltd., Minato-ku, Tokyo (JP)

(72) Inventors: Hideki Nonen, Mito (JP); Takashi Kumakura, Hitachinaka (JP)

(73) Assignee: Hitachi Metals, Ltd., Tokyo (JP)

( * ) Notice: Subject to any disclaimer, the term of this patent is extended or adjusted under 35 U.S.C. 154(b) by 0 days.

(21) Appl. No.: 15/610,758

(22) Filed: Jun. 1, 2017

(65) Prior Publication Data

US 2017/0352452 A1 Dec. 7, 2017

(30) Foreign Application Priority Data

Jun. 3, 2016 (JP) ..... 2016-112138

(51) Int. Cl.

| | |
|---|---|
| ***H01R 9/05*** | (2006.01) |
| ***H01B 11/18*** | (2006.01) |
| ***H01B 3/30*** | (2006.01) |
| ***H01B 3/44*** | (2006.01) |
| ***H01B 7/02*** | (2006.01) |
| ***H01B 7/08*** | (2006.01) |
| ***H01R 13/6581*** | (2011.01) |
| ***H01R 13/66*** | (2006.01) |
| *H01B 11/20* | (2006.01) |

(52) U.S. Cl.

CPC ..... *H01B 11/1895* (2013.01); *H01B 3/305* (2013.01); *H01B 3/441* (2013.01); *H01B 7/02* (2013.01); *H01B 7/08* (2013.01); *H01R 9/0515* (2013.01); *H01R 13/6581* (2013.01); *H01R 13/6658* (2013.01); *H01B 11/20* (2013.01)

(58) Field of Classification Search

CPC ..... H01R 9/05
USPC ..... 174/75 C, 88 C; 439/98, 497, 660
See application file for complete search history.

(56) References Cited

U.S. PATENT DOCUMENTS

| | | | | |
|---|---|---|---|---|
| 3,649,892 A * | 3/1972 | Booe | H01G 4/18 | 361/313 |
| 6,175,080 B1 * | 1/2001 | Nightingale | H01R 13/582 | 174/75 C |
| 6,428,355 B1 * | 8/2002 | Machado | H01R 9/0518 | 439/578 |
| 8,039,746 B2 * | 10/2011 | Ashida | H01R 13/5216 | 174/88 R |
| 8,753,144 B2 * | 6/2014 | Nakamura | H01R 4/023 | 439/493 |

(Continued)

FOREIGN PATENT DOCUMENTS

JP 2013-251223 A 12/2013

*Primary Examiner* — Chau N Nguyen
(74) *Attorney, Agent, or Firm* — Crowell & Moring LLP

(57) ABSTRACT

In a communication cable having a multi-core cable with a plurality of core cables in which a pair of signal lines are covered with an insulator, in which the insulator is covered with a shield tape, and in which the shield tape is covered with a wrapping tape, and having a connector formed on an end portion of the multi-core cable, the communication cable further has a case which is inserted/removed to/from a slot formed on a communication device to which the communication cable is connected, a substrate which is housed in the case and to which an end portion of the multi-core cable is connected, and a resin portion which molds a connection portion between the end portion of the multi-core cable and the substrate.

7 Claims, 8 Drawing Sheets

(56) References Cited

U.S. PATENT DOCUMENTS

2013/0333943 A1 12/2013 Tanaka et al.
2014/0154927 A1* 6/2014 Nonen ..... H01R 9/037
439/660

* cited by examiner

COMMUNICATION CABLE

CROSS-REFERENCE TO RELATED APPLICATION

The present application claims priority from Japanese Patent Application No. 2016-112138 filed on Jun. 3, 2016, the content of which is hereby incorporated by reference into this application.

TECHNICAL FIELD OF THE INVENTION

The present invention relates to a communication cable having a cable and a connector formed on an end portion of the cable.

BACKGROUND OF THE INVENTION

The cable configuring the communication cable has a signal line, an insulator which covers the signal line, a shield member which covers the insulator, and an insulating member which covers the shield member. Moreover, a multi-core cable is included in the cable configuring the communication cable. The multi-core cable described here means a cable obtained by collectively bundling a plurality of cables into one cable, each of which has the signal line, the insulator covering the signal line, the shield member covering the insulator and the insulating member covering the shield member. In the following explanation, individual cables included in the multi-core cable are referred to as "core cables" in some cases. Furthermore, when core cables included in the multi-core cable are used for transmitting operation signals, the core cable has a pair of signal lines, an insulator covering these signal lines, a shield member covering the insulator and an insulating member covering the shield member.

A connector which is formed on the cable including the multi-core cable is connectable to a communication device such as a server, a network switch or others. For example, the connector has a case that is insertable/removable to/from a slot (cage) formed on the communication device and a substrate housed in this case, and the end portion of the cable including the multi-core cable is connected to the substrate inside the case. More specifically, a connector pad is formed on one side of the substrate, and a signal pad and a ground pad are formed on the other side of the substrate.

Here, when the cable configuring the communication cable is a multi-core cable, the multi-core cable and the connector are connected with each other as follows to form one communication cable. On the end portion of the multi-core cable, a cable sheath or others is removed so that each core cable is exposed. On the end portion of each of the exposed core cables, an insulating member is removed so that the shield member and the signal line are exposed, and therefore, the shield member is solder-joined to the ground pad on the substrate so that the signal line is solder-joined to the signal pad on the substrate. Moreover, each base of the exposed core cables is integrally molded by resin.

On the other hand, the end portion of the substrate on which the connector pad is formed protrudes from the tip of the case so as to form a plug connector of a card edge type. When the case is inserted into the slot of the communication device, the end portion (plug connector) of the substrate on which the connector pad is formed is inserted into a receptacle connector formed inside the slot. Then, the connector pad formed on the substrate and a connection terminal formed on the receptacle connector are made in contact with each other so that the both of them are electrically connected to each other.

RELATED ART DOCUMENT

Patent Document

Patent Document 1: Japanese Patent Application Laid-open Publication No. 2013-251223

SUMMARY OF THE INVENTION

A plurality of slots are formed on the communication device, and these slots are arranged adjacent to each other. In recent years, the number of slots has tended to increase in order to achieve a high function and a high speed of the communication device. On the other hand, it is also required to downsize the communication device. Therefore, in order to add the slots while meeting the requirement for the downsizing of the communication device, a plurality of slots are arranged with a higher density.

That is, the connector of the communication cable is configured to be connected to each of the plurality of slots that are arranged with a high density. As a result, a large number of communication cables are drawn from a front panel and a rear panel of the communication device on which the slot is formed, and therefore, a degree of freedom in handling the communication cables in the vicinity of the communication device is lowered. Under such circumstances, a bending force and a tensile force are applied to the cables configuring the communication cable often.

Here, when the cable configuring the communication cable is a multi-core cable, the base of each of core cables is molded by resin inside the connector (case). However, this molding resin is used for molding the bases of the plurality of core cables onto each other, but not used for molding the connection portions between the core cables and the substrate. That is, the joint portion between the shield member and the substrate and the joint portion between the signal line and the substrate are not molded.

For this reason, when a bending force and a tensile force exceeding an assumed range are applied to the multi-core cable extending from the case, there is a risk of application of an excessive force to the connection portion between each core cable and the substrate, which results in damaging the connection portion. For example, there are risks of peeling off of the ground pad to which the shield member is solder-joined from the substrate and peeling off of the signal pad to which the signal line is solder-joined from the substrate. Moreover, there are risks of peeling off of the solder-joint portion between the shield member and the ground pad and peeling off of the solder-joint portion between the signal line and the signal pad. There is a risk of occurrence of such damages of these connection portions even when the cable configuring the communication cable is not the multi-core cable.

An object of the present invention is to achieve a communication cable in which the connection portion between the cable and the substrate is difficult to be damaged even when the force exceeding the assumed range is applied to the cable.

The communication cable of the present invention includes a cable and a connector formed on the cable, the cable including a signal line, an insulator covering the signal line, a shield member covering the insulator, and an insulating member covering the shield member. Moreover, the communication cable has a case which is inserted/removed to/from a slot formed on the communication device to which the communication cable is connected, a substrate housed in the case and to which the end portion of the cable is connected, and a resin portion molding a connection portion between the end portion of the cable and the substrate.

According to the present invention, it is possible to achieve a communication cable in which a connection portion between a cable and a substrate is difficult to be damaged even when a force exceeding an assumed range is applied to the cable.

BRIEF DESCRIPTIONS OF THE DRAWINGS

DESCRIPTIONS OF THE PREFERRED EMBODIMENTS

Figure 1:
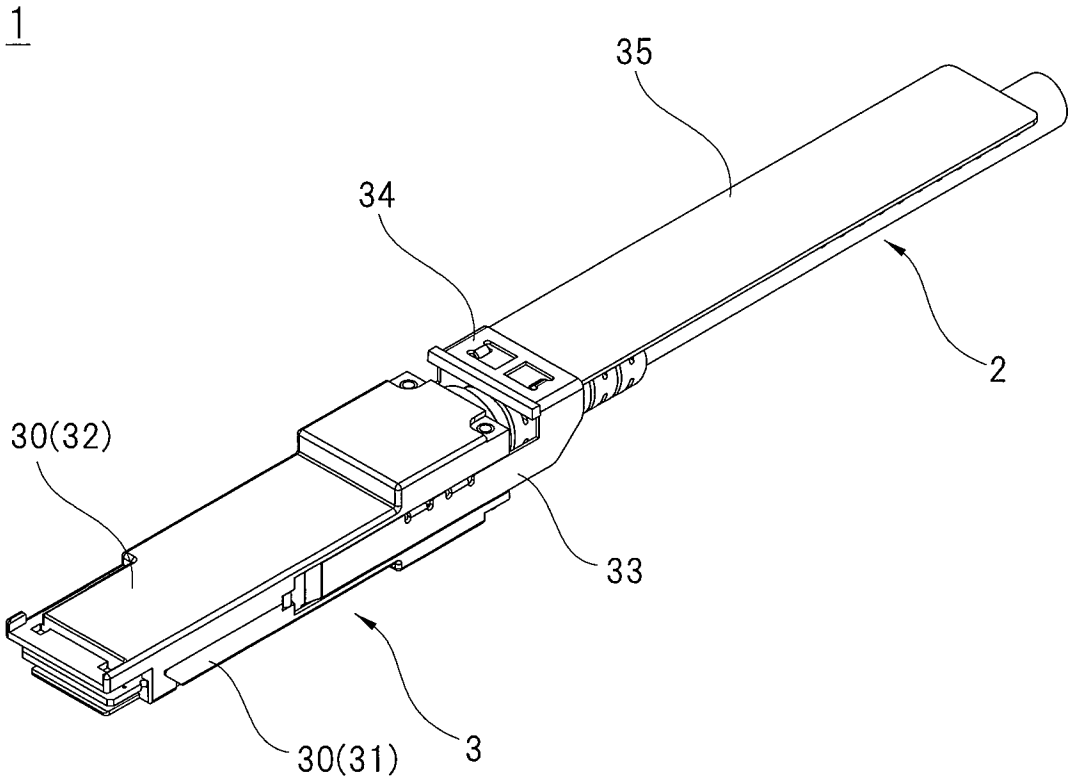
FIG. 1 is a perspective view showing an appearance of a communication cable.

Hereinafter, one example of an embodiment of a communication cable of the present invention will be described in detail with reference to the drawings. In the following explanation, note that the same or substantially the same components are denoted with the same reference character in each reference drawing.

Figure 3A:
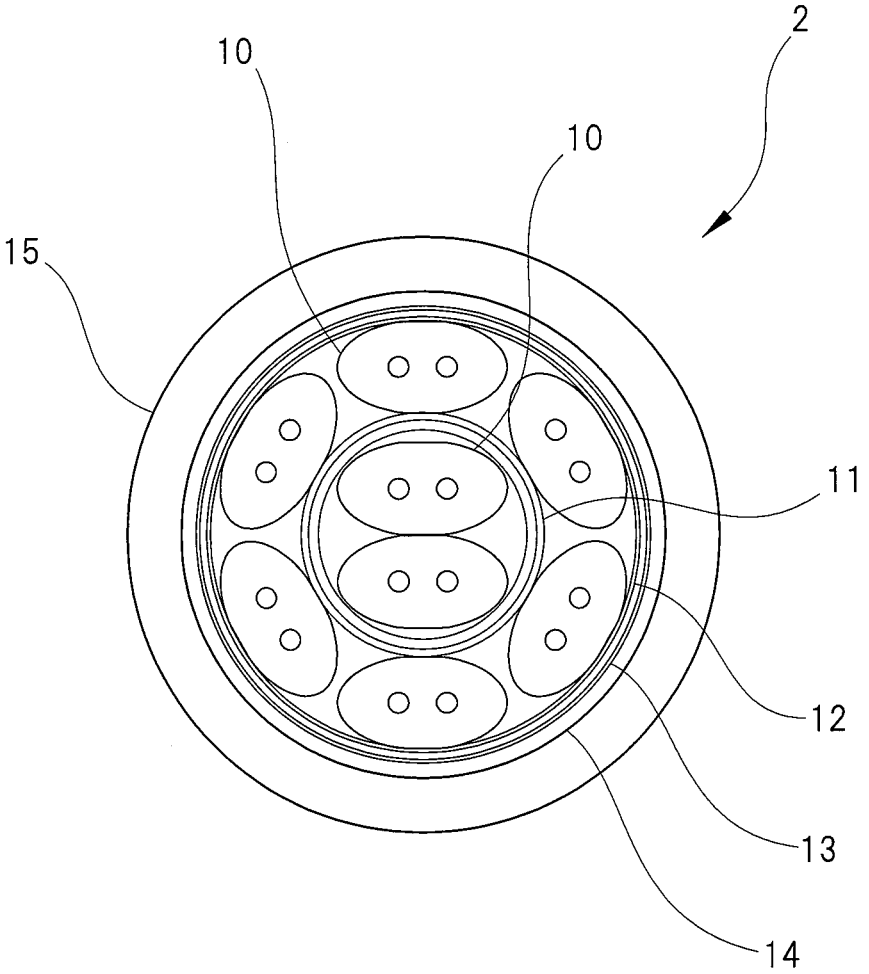
FIG. 3A is a cross-sectional view showing a structure of a multi-core cable.

A communication cable 1 shown in FIG. 1 is provided with a multi-core cable 2 serving as a cable, and a connector 3 formed on the multi-core cable 2. The communication cable 1 is a multi-channel communication cable for transmitting differential signals, and is used for high-speed signal transmission of several tens of Gbit/sec or higher per channel. Specifically, the communication cable 1 is used for 4 channels. Therefore, as shown in FIG. 3A, the multi-core cable 2 includes 8 (2 cables/1 channel) core cables 10. More specifically, two core cables 10 are arranged in the center of the multi-core cable 2, and six core cables 10 are arranged outside the two core cables 10 so as to surround the two core cables 10. A buffer tape 11 is wound around the two center core cables 10, and another buffer tape 12 is wound around the six outer core cables 10. In other words, the buffer tape 11 is interposed between the two inner core cables 10 and the six outer core cables 10. Moreover, a metal foil tape (aluminum tape 13) is wound around the buffer tape 12, the aluminum tape 13 is covered with a copper wire (braid wire 14) braided into a net shape, and the braid wire 14 is covered with a sheath (jacket) 15. Note that the aluminum tape 13 and the braid wire 14 form a shield layer for shielding noises. That is, a plurality of (8 in the present embodiment) core cables 10 included in the multi-core cable 2 are covered with the shield layer. Note that the buffer tape 11 is configured by an insulating tape made of, for example, heat resistant PVC.

Figure 3B:
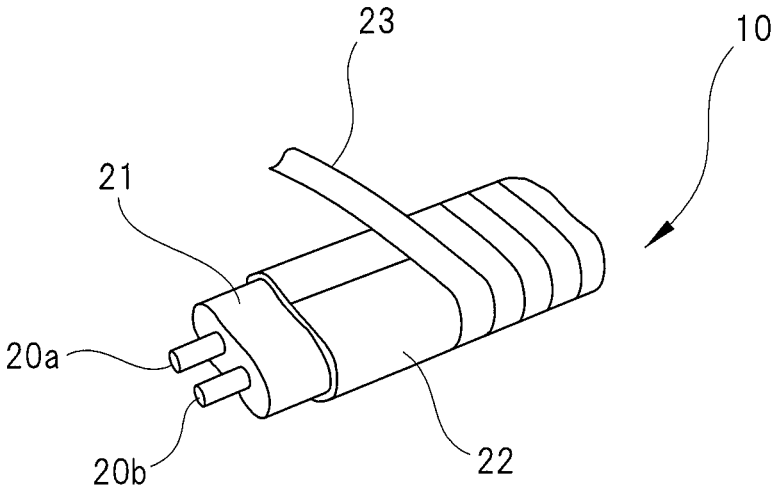
FIG. 3B is a perspective view showing a structure of a core cable.

As shown in FIG. 3B, each of the core cables 10 included in the multi-core cable 2 has a pair of signal lines 20*a* and 20*b* through which phase-reversal signals are transmitted, an insulator 21 covering these signal lines 20*a* and 20*b*, a shield member (shield tape 22) covering the insulator 21, and an insulating member (wrapping tape 23) covering the shield tape 22. In this manner, the multi-core cable 2 has the plurality of core cables 10, and each of the core cables 10 has the signal lines 20*a* and 20*b*, the insulator 21, the shield tape 22 serving as a shield member and the wrapping tape 23 serving as an insulating member. Of course, the shield member is not limited to the shield tape 22, and the insulting member is not limited to the wrapping tape 23. In the following explanation, when the signal lines 20*a* and 20*b* included in each of the core cables 10 are not particularly distinct from each other, note that the two lines are collectively referred to as "signal line 20" in some cases.

The shield tape 22 is a laminate body formed of a resin film and a metal film, and is longitudinally wrapped around the insulator 21 so that the resin film is placed inside. The wrapping tape 23 is a tape for preventing loosening of the shield tape 22, and is laterally wrapped (helically wrapped) around the shield tape 22. Note that the shield tape 22 of the present embodiment is a laminate body formed of a PET film and a copper film. However, a material for each film configuring the shield tape 22 is not limited to such a specific material. Moreover, the number of the laminating films configuring the shield tape 22 is not limited to such a specific number of laminating films, either.

Figure 2:
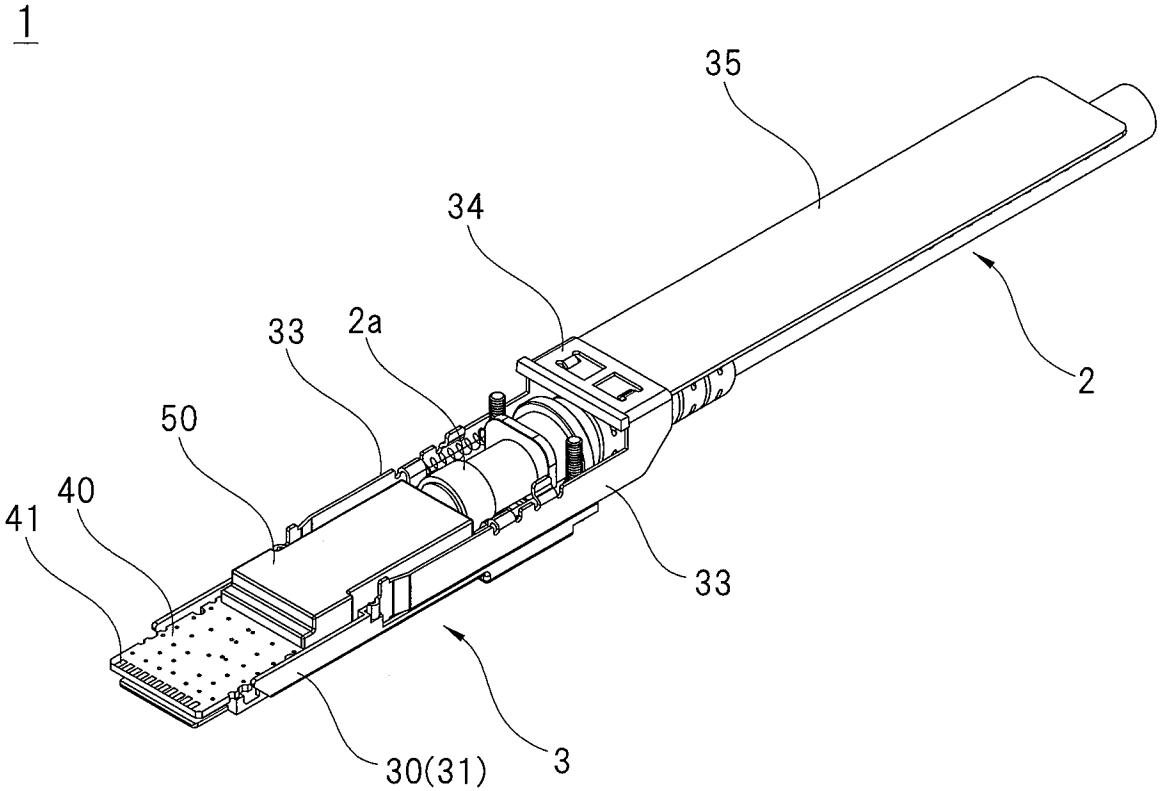
FIG. 2 is a perspective view showing an inner structure of a connector.

With reference to FIG. 1 again, the connector 3 has a case 30 configured by a lower case 31 and an upper case 32 made of metal. As shown in FIG. 2, the substrate 40 is housed in the case 30, and the substrate 40 housed in the case 30 is fixed inside the case 30. Moreover, the end portion of the multi-core cable 2 is drawn into the case 30, and the end portion of the multi-core cable 2 is connected to the substrate 40. Furthermore, the connection portion between the end portion of the multi-core cable 2 and the substrate 40 is molded by a resin portion 50. The details of the resin portion 50 and the connection portion between the substrate 40 and the end portion of the multi-core cable 2 molded by the resin portion 50 will be described later.

As shown in FIG. 1 and FIG. 2, a latch 33 which slides in the longitudinal direction of the case 30 is formed on both side surfaces of the case 30. Respective ends of the latches 33 are coupled to each other through a coupling portion 34, and a pull tab 35 is attached to the coupling portion 34. The pull tab 35 extends toward a rear side of the case 30 along the multi-core cable 2 extending from the case 30.

The connector 3 (case 30) has such a shape and a dimension that are insertable/removable to/from the slot (cage) formed in the communication device. When the connector 3 is inserted into the cage, a locking piece formed on the cage is engaged with the connector 3. Meanwhile, when the pull tab 35 is pulled rearward to slide the latch 33 in the same direction, the engagement of the locking piece with the connector 3 is released. Specifically, the above-described locking piece is formed on each of both sidewalls of the cage, which face with each other. When the connector 3 is inserted into the cage, each locking piece is fitted to an engaging portion formed on each of both side surfaces of the connector 3. As a result, the locking pieces are engaged with the connector 3, so that the connector 3 is not pulled out of the cage. On the other hand, when the pull tab 35 is pulled to slide the latches 33 rearward, the locking pieces engaged with the engaging portions are pushed outward from the engaging portions by the tips of the latches 33. As a result, the engagement of the locking pieces with the connector 3 is released, so that the connector 3 can be pulled out of the cage.

Figure 4:
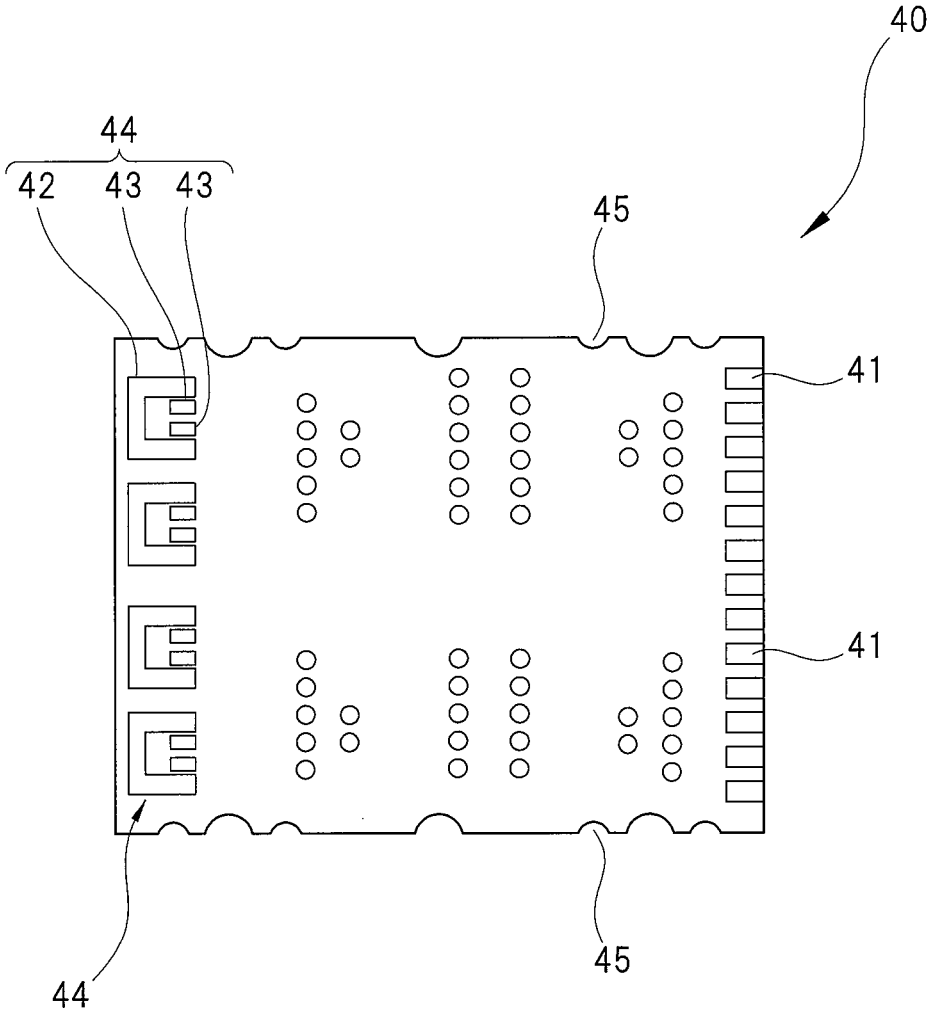
FIG. 4 is a plan view showing a layout of a pad on a substrate.

Next, mainly with reference to FIG. 4 to FIG. 6, the details of the resin portion 50 shown in FIG. 2 and the connection portion between the substrate 40 and the end portion of the multi-core cable 2 molded by the resin portion 50 will be described. FIG. 4 is an enlarged plan view of the substrate 40. The substrate 40 shown in the drawing is a glass epoxy substrate, and has a rectangular plane shape as a whole. A plurality of connector pads 41 are formed along one short side of a front surface of the substrate 40, and a plurality of ground pads 42 and signal pads 43 are formed along the other short side. The connector pads 41 and the signal pads 43 are electrically connected to each other through a wiring pattern formed on the substrate 40 although not shown. Note that a signal processing IC is formed on the wiring pattern for use in connecting the connector pads 41 and the signal pads 43 in some cases. The following explanation defines a side on which the connector pads 41 are formed among both sides of the substrate 40 in the longitudinal direction as a front side or a forward end side, and defines a side on which the ground pads 42 and the signal pads 43 are formed as a rear side or a rearward end side. Of course, these definitions are only definitions for convenience of explanation.

As shown in FIG. 4, four ground pads 42 are formed on the rear side of the front surface of the substrate 40. Each of the ground pads 42 has a U-shaped plane shape, and two signal pads 43 are formed inside each ground pad 42. These three pads (one ground pad 42 and two signal pads 43 inside the ground pad) are formed as a set so as to form one connection pad group 44. Moreover, one connection pad group 44 corresponds to one core cable 10 (FIG. 3A). That is, on the front surface of the substrate 40, four connection pad groups 44 corresponding to four core cables 10 are formed. Furthermore, although not shown in the drawings, the same four connection pad groups 44 are formed on the rear surface of the substrate 40. That is, eight connection pad groups 44 in total are formed on the substrate 40. Note that the same connector pads as the connector pads 41 shown in FIG. 4 are also formed on the rear surface of the substrate 40.

As shown in FIG. 2, the forward end side of the substrate 40 protrudes forward from the case 30, and the connector pads 41 formed on the substrate 40 are exposed out of the case 30. The forward end side of the substrate 40 including the connector pads 41 exposed out of the case 30 forms a plug connector of a card edge type.

As shown in FIG. 4, a plurality of cut-out portions 45 are formed on each long side of the substrate 40. These cut-out portions 45 are used for positioning the substrate 40 while being engaged with protrusions formed inside the lower case 31 (FIG. 2).

Figure 5:
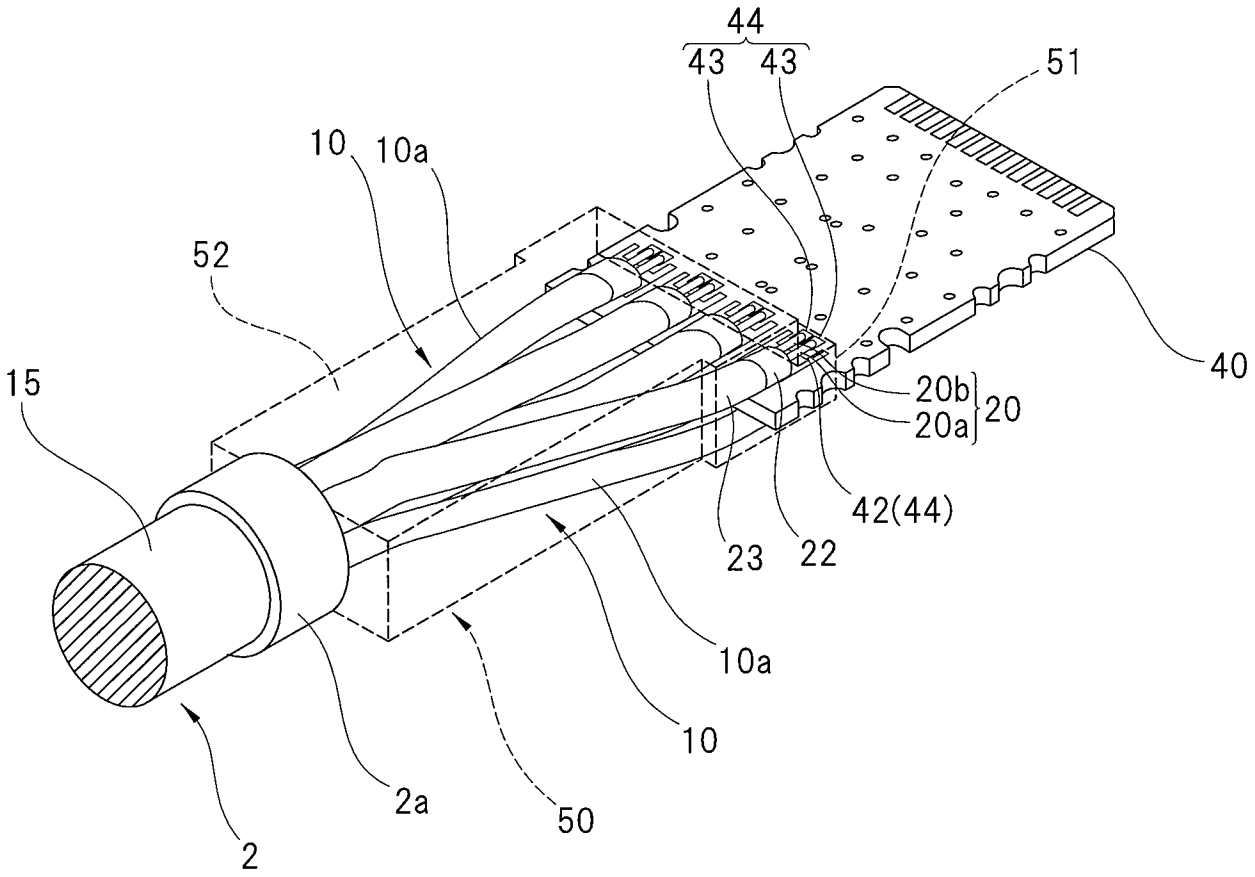
FIG. 5 is an explanatory view showing a connection structure between a multi-core cable and the substrate.

As shown in FIG. 5, the sheath 15, the braid wire 14, the aluminum tape 13, the buffer tape 12 and the buffer tape 11 shown in FIG. 3A are removed in the end portion of the multi-core cable 2 drawn into the case 30 (FIG. 2), so that the end portions of the respective core cables 10 are exposed. At the same time, the end portions of the respective core cables 10 are released from the bonding by the sheath 15, the braid wire 14, the aluminum tape 13, the buffer tape 12 and buffer tape 11, so as to be separated from each other. That is, the multi-core cable 2 is branched into eight lines inside the connector 3 (FIG. 2). Therefore, in the following explanation, each end portion of the core cables 10 that are released from the bonding by the sheath 15 and others and are separated from each other is referred to as "branch wire 10*a*" to be distinct from other portions of the multi-core cables 10 in some cases. That is, inside the connector 3 (FIG. 2), eight branch wires 10*a* extend from the end portion of the multi-core cable 2. Of course, the above-described distinction is only distinction for convenience of explanation, and each branch wire 10*a* is a part of each core cable 10, and is continuously formed from the other portions. Therefore, each branch wire 10*a* has substantially the same cross-sectional structure as the cross-sectional structure shown in FIG. 3B.

Note that a ring-shaped shield connection member 2*a* shown in FIG. 5 is made of a metallic material. From the outer periphery, the shield connection member 2*a* swages the aluminum tape 13 and the braid wire 14 that are folded back at the end portion of the sheath 15 onto the sheath 15, so that the shield connection member 2*a* is electrically connected to these members. Moreover, the shield connection member 2*a* is made in contact with the metallic case 30 (FIG. 2). That is, the aluminum tape 13 and the braid wire 14 are electrically connected to the case 30 through the shield connection member 2*a*.

As shown in FIG. 5, each of the end portions of the respective branch wires 10*a* has a region where the wrapping tape 23 shown in FIG. 3B is removed so that the shield tape 22 is exposed, and a portion beyond the region has another region where not only the wrapping tape 23 but also the shield tape 22 and the insulator 21 are removed so that the signal line 20 is exposed.

The signal line 20 and the shield tape 22 that are exposed at the end portion of each of the branch wires 10*a* are connected to the connection pad group 44 corresponding to each of the branch wires 10*a*. More specifically, the signal lines 20*a* and 20*b* of one branch wire 10*a* are solder-joined to the signal pads 43 and 43 belonging to the corresponding connection pad group 44, respectively, and the shield tape 22 of the branch wire 10*a* is solder-joined to the ground pad 42 belonging to the same connection pad group 44 as the connection pad group 44 to which the signal pads 43 belong, the signal pads 43 being solder-joined with the signal lines 20*a* and 20*b* of the corresponding branch wire 10*a*.

Therefore, the substrate 40 has eight joint portions at each of which the corresponding core cable 10 (branch wire 10*a*) and the connection pad group 44 are solder-joined to each other. Specifically, the front surface of the substrate has four joint portions, and the rear surface of the substrate has four joint portions. Moreover, as shown in FIG. 6, the joint portions include a first joint portion at which the signal line 20 and the signal pad 43 (FIG. 4, FIG. 5) are solder-joined to each other and a second joint portion at which the shield tape 22 and the ground pad 42 (FIG. 4, FIG. 5) are solder-joined to each other.

Figure 6:
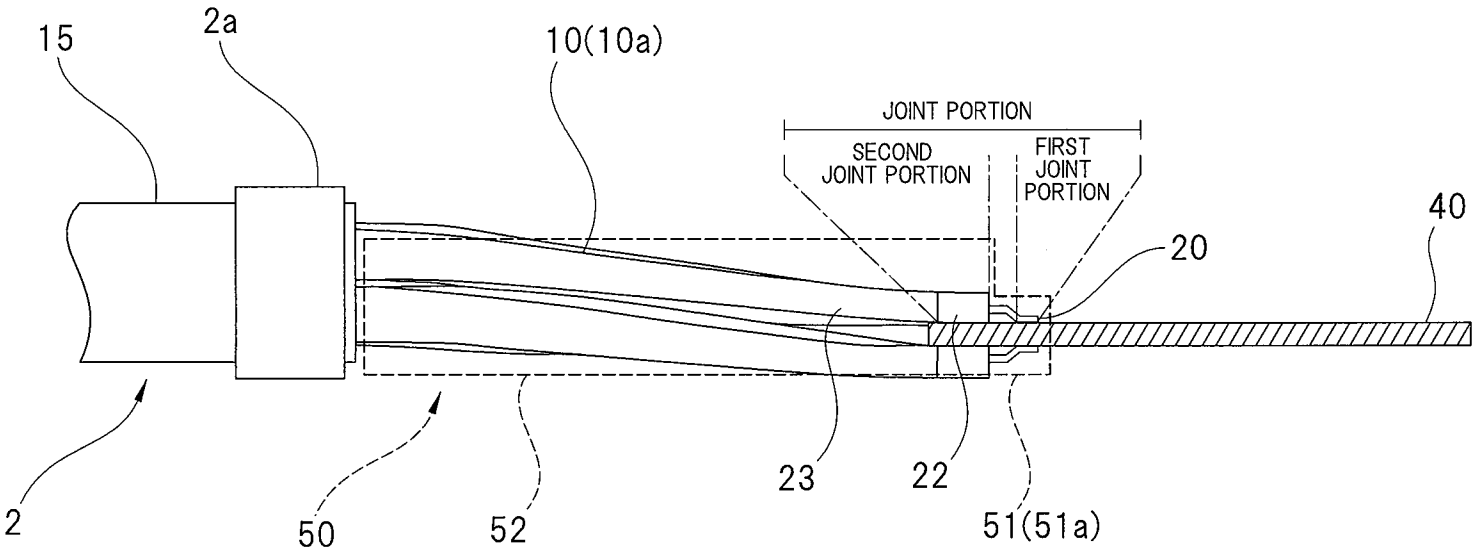
FIG. 6 is another explanatory view showing the connection structure between the multi-core cable and the substrate.

As shown in FIG. 5 and FIG. 6, eight joint portions each of which includes the first joint portion and the second joint portion are collectively molded together with the substrate 40 by a resin portion 50. That is, the plurality of first joint portions and second joint portions located on the substrate 40 are collectively molded together with the substrate 40 by the resin portion 50.

Figure 7:
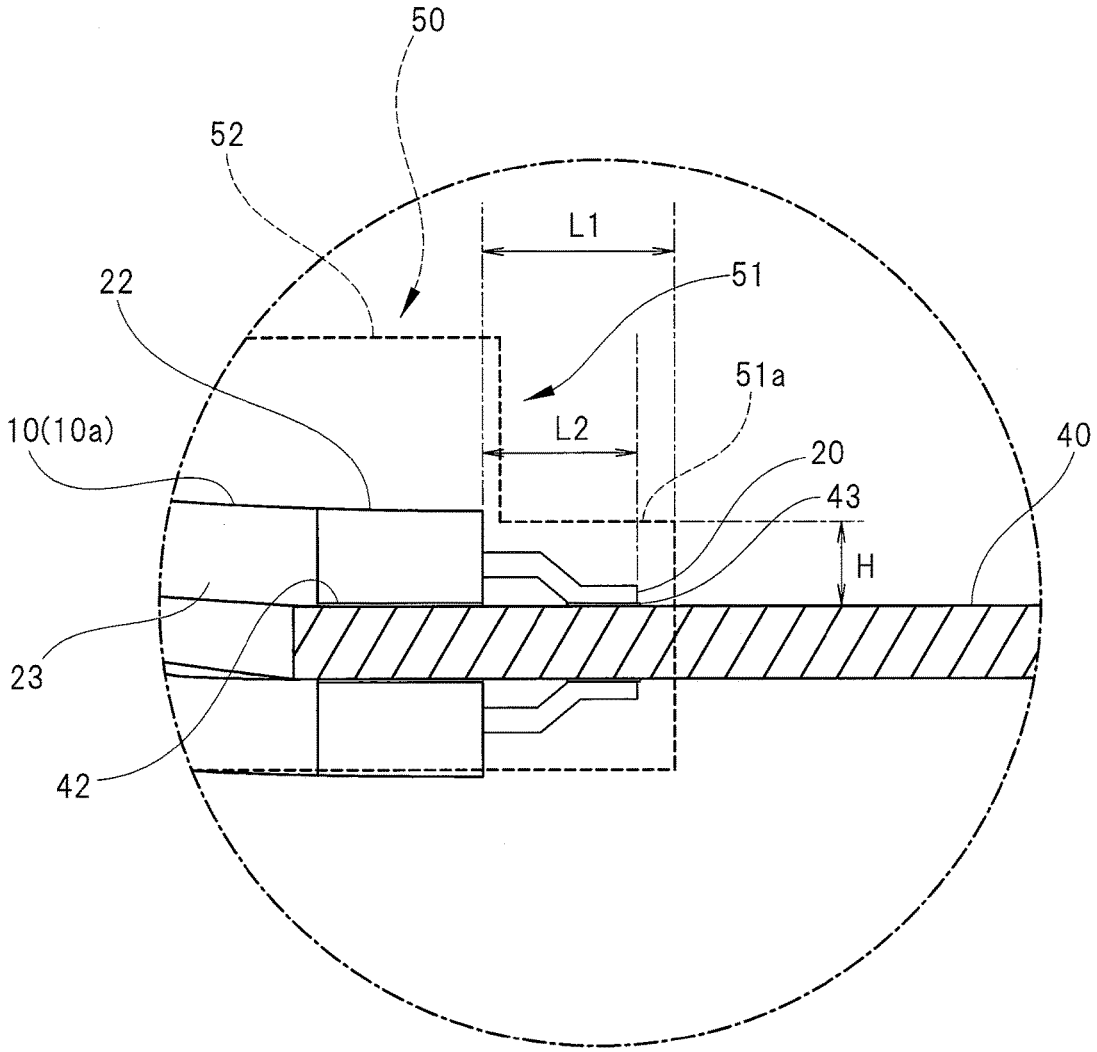
FIG. 7 is still another explanatory view showing the connection structure between the multi-core cable and the substrate.

As shown in FIG. 7, the resin portion 50 has a first mold portion 51 for molding at least the signal line 20 and a second mold portion 52 for molding at least the shield tape 22. As shown in FIG. 5 and FIG. 6, the second mold portion 52 in the present embodiment extends to the base or its vicinity of each of the branch wires 10*a* beyond the rearward end of the substrate 40. That is, the second mold portion 52 molds substantially the entire length of each of the branch wires 10*a* except for the signal line 20. As a result, the eight branch wires 10*a* are integrated by the second mold portion 52 of the resin portion 50.

As described above, in the present embodiment, the connection portion between the end portion of the multi-core cable 2 and the substrate 40 is molded by the resin portion 50. Specifically, the connection portion between the end portion of each core cable 10 included in the multi-core cable 2 and the substrate 40 is molded by the resin portion 50. More specifically, the first joint portion at which the signal line 20 of each core cable 10 and the substrate 40 are solder-joined to each other and the second joint portion at which the shield tape 22 of each core cable 10 included in the multi-core cable 2 and the substrate 40 are solder-joined to each other are molded to each other by the resin portion 50. Furthermore, a plurality of the first joint portions and the second joint portions are located on the substrate 40, and the plurality of first joint portions and second joint portions are collectively fixed to the substrate 40 by the resin portion 50. Therefore, even when a bending force and a tensile force are applied to the multi-core cable 2 extending from the connector 3 (case 30), the connection portion between the end portion of each core cable 10 and the substrate 40, that is, the first joint portion and second joint portion, are difficult to be damaged. For example, the solder joint between the signal line 20 and signal pad 43 at the first joint portion is difficult to be broken, and the signal pad 43 is difficult to be peeled off from the front surface of the substrate.

Meanwhile, when the first joint portion which is the connection portion between the signal line 20 and the substrate 40 is molded by the resin portion 50, an impedance of the first joint portion is lowered by a dielectric constant of the resin portion 50. Then, when a high-speed signal of several tens of Gbit/sec or higher is transmitted, there is a risk of reflection of the signal due to impedance mismatching.

Therefore, as shown in FIG. 6 and FIG. 7, a thickness of a part of the first mold portion 51 is made thinner than a thickness of the second mold portion 52. In other words, a thin thickness portion 51*a* having a thickness thinner than that of the second mold portion 52 is formed in the first mold portion 51. As a result, the forward end side of the resin portion 50 has a step shape. Thus, influence of the dielectric constant of the resin portion 50 on the first joint portion is reduced, so that the impedance mismatching is suppressed. Meanwhile, from the viewpoint of suppressing the damage on the first joint portion by an external force, it is desirable to cover the entire signal line 20 with the resin portion 50. Therefore, in the present embodiment, a height (H) of the thin thickness portion 51*a* of the first mold portion 51 shown in FIG. 7 is made larger than a diameter of the signal line 20. Moreover, a length (L1) of the first mold portion 51 including the thin thickness portion 51*a* is made longer than a length (L2) of a portion exposed from the shield tape 22 of the signal line 20. In other words, the region having the length (L1) shown in FIG. 7 is the first mold portion 51, and the first mold portion 51 includes the thin thickness portion 51*a* thinner than the second mold portion 52. In this manner, the first mold portion 51 in the present embodiment covers the entire signal lines 20 so as to be thicker and longer than the signal line 20. Note that the diameter of the signal line 20 in the present embodiment is about 4 mm. Moreover, the rear surface side of the substrate 40 is also molded by the resin portion 50, and the height (thickness) of the resin portion 50 on the rear surface side of the substrate 40 is the same as the height (H) of the thin thickness portion 51*a*.

The present invention is not limited to the above-described embodiments, and can be variously modified within a scope of the invention. For example, the resin portion 50 in the above-described embodiments is made of polyamide. However, the resin material for forming the resin portion 50 is not particularly limited to this material. In place of polyamide, the resin portion 50 may be made of, for example, polypropylene or ethylene-vinyl acetate copolymer resin. Of course, from the viewpoint of suppressing the impedance mismatching due to the influence of the dielectric constant, it is preferable to form the resin portion 50 by using a resin material having a dielectric constant lower than that of the substrate 40, and it is more preferable to form the resin portion 50 by using a resin material having a dielectric constant of 2.5 or less. Note that the resin portion 50 of the above-described embodiments is made of a resin material having a dielectric constant of 2.5. Moreover, the dielectric constant of the substrate 40 in the above-described embodiments is 3.8. Note that the dielectric constant (2.5) of the resin material is a value measured at a frequency of 1 kHz by using a cavity resonator perturbation method in compliance with JIS-C-2138 (2007). Moreover, the dielectric constant (3.8) of the substrate 40 is a value measured at a frequency of 1 GHz by using a parallel plate capacitor method in compliance with IPC TM-650 2.5.5.9.

Furthermore, from the viewpoint of suppressing the damage on the connection portion due to an external force, it is preferable to form the resin portion 50 by a resin material having a tensile shear adhesive strength of 4.8 Mpa or more.

Figure 8B:
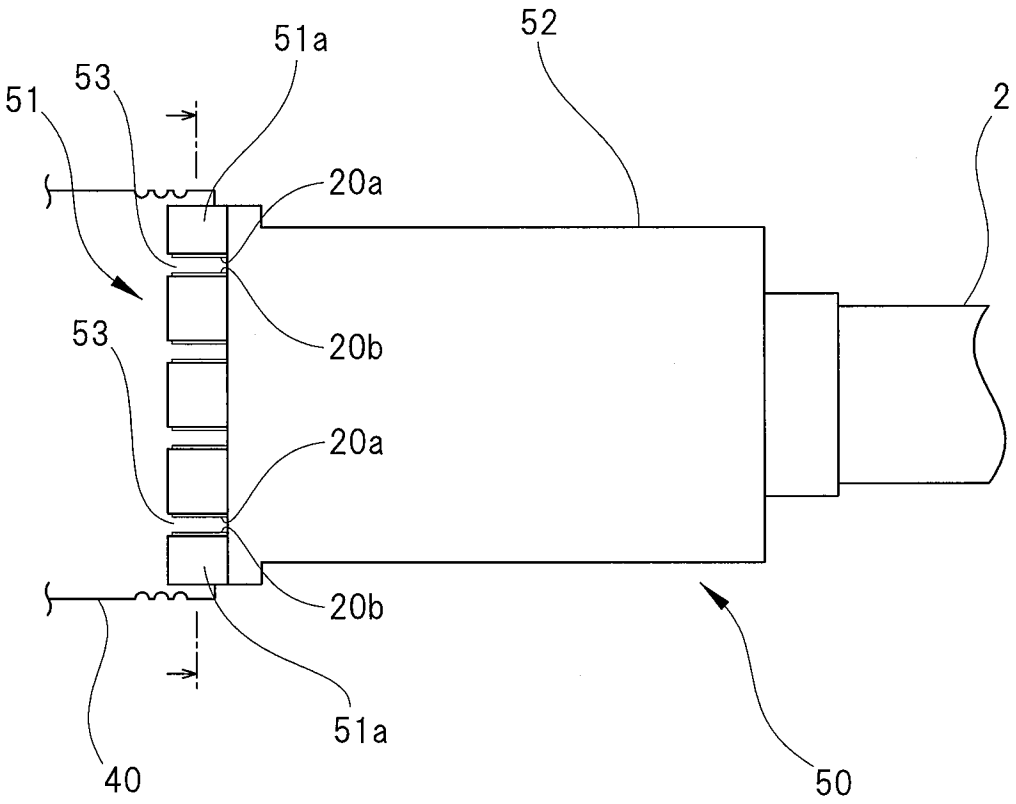
FIG. 8B is a plan view thereof.
Figure 8A:
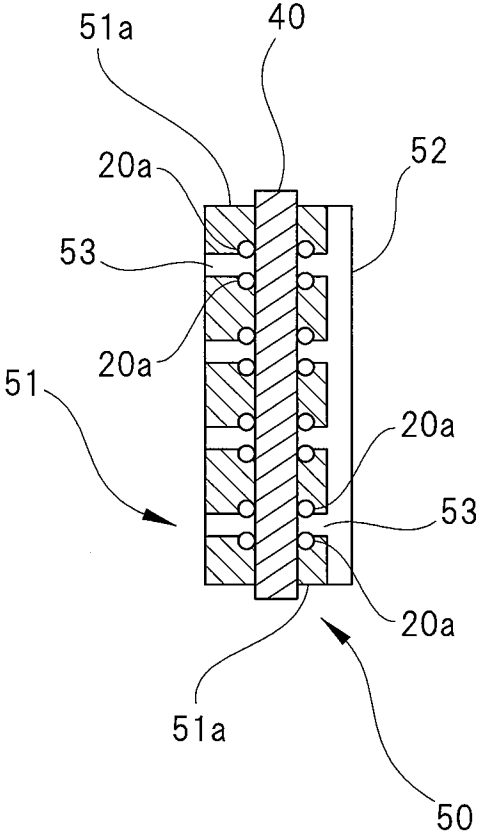
FIG. 8A is a cross-sectional view showing one of modified examples of a resin portion.

The shape of the resin portion 50 can be appropriately changed. FIG. 8 shows one modified example of the resin portion 50. In the shown resin portion 50, the first mold portion 51 is formed into a comb teeth shape. Specifically, in the first mold portion 51, a plurality of gaps 53 are formed with predetermined pitches along its width direction. Each of the gaps 53 is formed between the paired signal lines 20*a* and 20*b*. That is, no mold resin is interpolated between the paired signal lines 20*a* and 20*b*, so that one portion of each of the signal lines 20*a* and 20*b* is exposed. Therefore, influence of the dielectric constant of the resin portion 50 on the first joint portion is further reduced, so that the impedance mismatching is further suppressed.

The communication cable of the present invention includes a communication cable having a connector formed on an end portion of one cable in which a signal line is covered with an insulator, in which the insulator is covered with a shield member, and in which the shield member is covered with an insulating member. Moreover, the cable configuring the communication cable of the present invention includes a multi-core cable obtained by collectively bundling a plurality of core cables into one cable, each of which includes one signal line. That is, the multi-core cable including a plurality of core cables that are not used for transmission of differential signals is also included in the cable configuring the communication cable of the present invention.

What is claimed is:

1. A communication cable including a cable and a connector formed on the cable, the cable including a signal line, an insulator covering the signal line, a shield member covering the insulator, and an insulating member covering the shield member, the communication cable comprising:

a case which is inserted/removed to/from a slot formed on a communication device to which the communication cable is connected;

a substrate housed in the case and to which an end portion of the cable is connected; and a resin portion molding a connection portion between the end portion of the cable and the substrate, wherein a first joint portion at which the signal line and the substrate are solder-joined to each other and a second joint portion at which the shield member and the substrate are solder-joined to each other are molded by the resin portion, the resin portion includes a first mold portion molding at least the signal line and a second mold portion molding at least the shield member, the first mold portion includes a thin thickness portion thinner than the second mold portion, and a plurality of gaps are formed on the first mold portion with predetermined pitches along a width direction.

2. The communication cable according to claim 1, wherein the cable is a multi-core cable obtained by collectively bundling a plurality of core cables into one cable, each including the signal line, the insulator, the shield member and the insulating member.

3. The communication cable according to claim 1, wherein the thin thickness portion is thicker than a diameter of the signal line.

4. The communication cable according to claim 1, wherein the resin portion is made of a resin material with a dielectric constant lower than a dielectric constant of the substrate.

5. The communication cable according to claim 4, wherein the dielectric constant of the resin material is 2.5 or less.

6. The communication cable according to claim 1, wherein the resin portion is made of a resin material with a tensile shear adhesive strength of 4.8 Mpa or more.

7. The communication cable according to claim 1, wherein the resin portion is made of polyamide, polypropylene or ethylene-vinyl acetate copolymer resin.

* * * * *